US009469462B2

(12) United States Patent
Liu et al.

(10) Patent No.: US 9,469,462 B2
(45) Date of Patent: Oct. 18, 2016

(54) FLUID SUPPLY DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventors: Han-Pin Liu, New Taipei (TW); Chuan Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/591,211

(22) Filed: Jan. 7, 2015

(65) Prior Publication Data

US 2016/0167865 A1 Jun. 16, 2016

(30) Foreign Application Priority Data

Dec. 10, 2014 (CN) ..... 2014 1 0750550

(51) Int. Cl.
*B67D 7/60* (2010.01)
*B65D 83/00* (2006.01)

(52) U.S. Cl.
CPC ..... *B65D 83/0005* (2013.01)

(58) Field of Classification Search
CPC ..... B65D 83/0005; B65D 83/0011; B65D 83/0016; B65D 83/0027
USPC ..... 222/41, 46, 47, 48, 256, 257, 259, 260, 222/309, 519, 520, 390, 501
See application file for complete search history.

(56) References Cited

U.S. PATENT DOCUMENTS 326,520 A * 9/1885 Powell ..... F16N 11/04 184/45.1
417,430 A * 12/1889 Lonergan ..... F16N 11/04 184/105.2
993,436 A * 5/1911 Burke et al. ..... G01F 11/021 222/309
1,041,840 A * 10/1912 Miller ..... B65D 83/0011 184/105.2
1,051,609 A * 1/1913 McClung ..... F16N 11/02 184/38.4
2,300,110 A * 10/1942 De Hoog ..... B28C 7/122 222/253
2,530,909 A * 11/1950 Riggs ..... A61M 1/00 132/74.5
3,203,455 A * 8/1965 Horabin ..... G01N 30/18 141/329
4,144,761 A * 3/1979 Dzaack ..... B01L 3/0224 222/309
4,526,294 A * 7/1985 Hirschmann ..... B01L 3/0282 222/309
4,823,818 A * 4/1989 De Buyer ..... A47L 15/4418 134/95.1
8,590,747 B2 * 11/2013 Keller ..... A61B 17/00491 222/137
2008/0110922 A1 * 5/2008 Sines ..... B65D 21/08 221/279
2011/0049186 A1 * 3/2011 Chen ..... B05C 17/0054 222/146.6

* cited by examiner

*Primary Examiner* — Patrick M Buechner
(74) *Attorney, Agent, or Firm* — Zhigang Ma

(57) ABSTRACT

A fluid supply device includes a base member including an end plate and a rod perpendicularly extending from a first end of the end plate and defining a first channel axially and a through slot radially, a container attached to a second end of the end plate opposite to the first end and defining a second channel to contain fluid, a pushing member slidably received in the first channel and the second channel, an actuating sleeve threadedly engaging with the rod, and a fixing member attached to the actuating sleeve and extending through the through slot and the pushing member. The actuating sleeve is rotated to drive the pushing member to slide in the first channel and the second channel to push the fluid.

14 Claims, 9 Drawing Sheets

FLUID SUPPLY DEVICE

FIELD

The subject matter herein generally relates to a fluid supply device.

BACKGROUND

Fluid supply devices are designed for supplying fluid.

BRIEF DESCRIPTION OF THE DRAWINGS

Implementations of the present technology will now be described, by way of example only, with reference to the attached figures.

DETAILED DESCRIPTION

Figure 1:
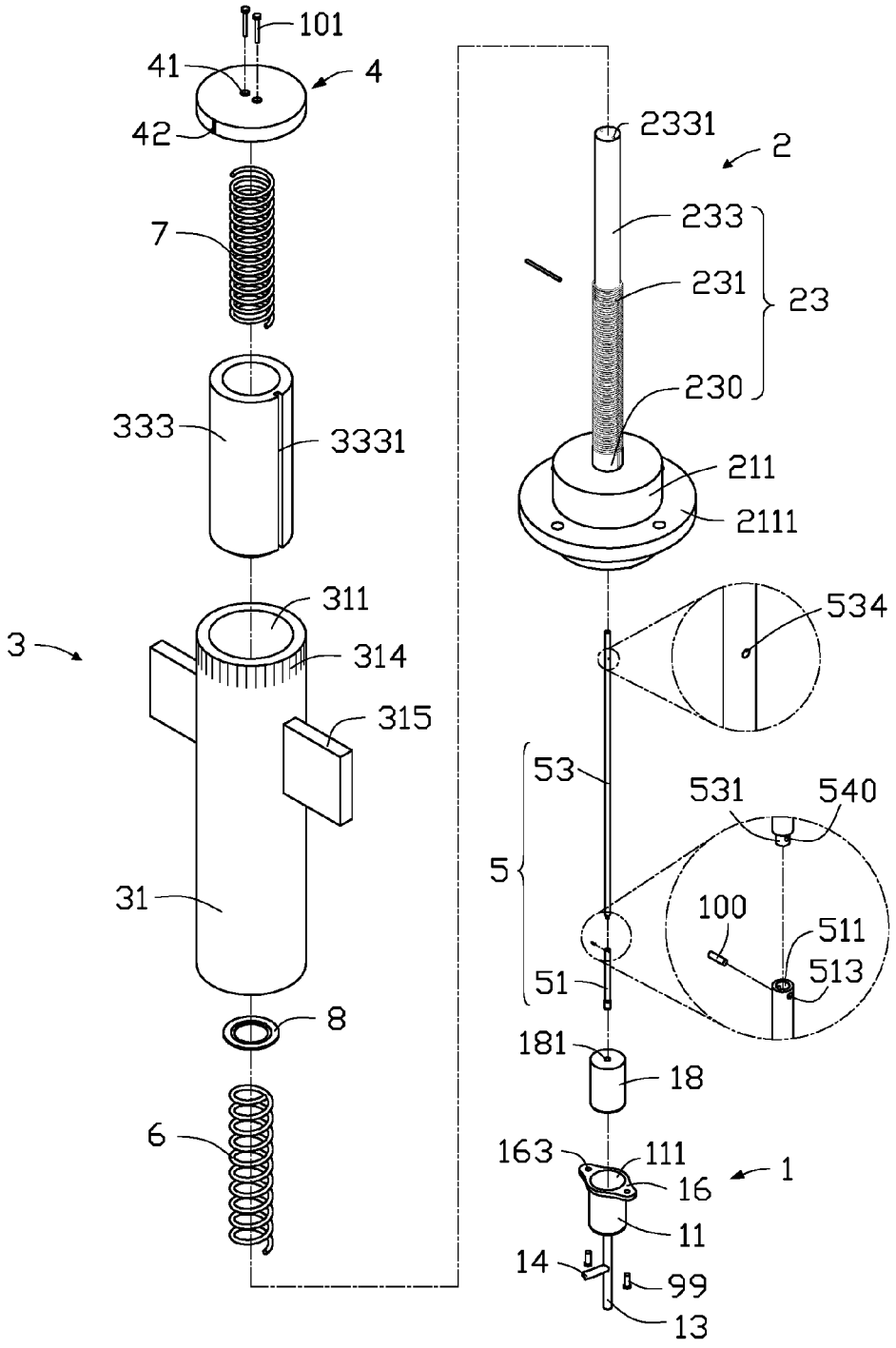
FIG. 1 is an exploded, isometric view of an embodiment of a fluid supply device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "comprising" means "including, but not necessarily limited to"; it specifically indicates open-ended inclusion or membership in a so-described combination, group, series and the like.

The present disclosure describes a fluid supply device.

Figure 2:
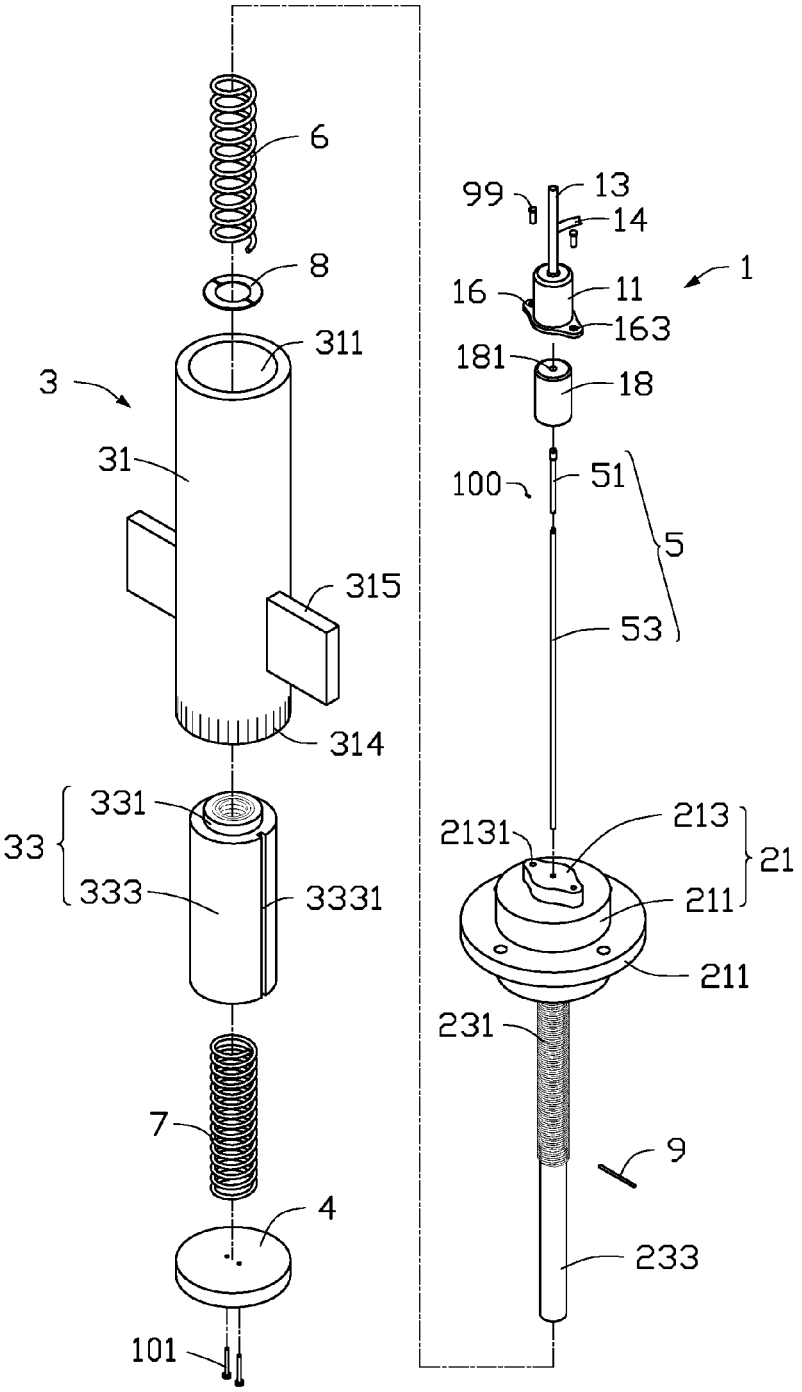
FIG. 2 is similar to FIG. 1, but viewed from another angle.
Figure 3:
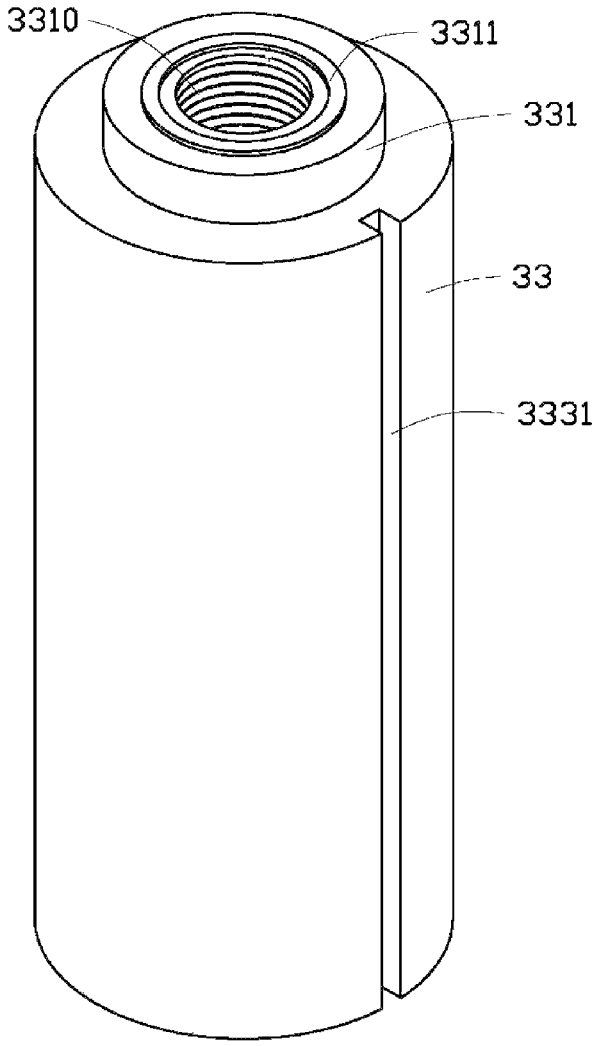
FIG. 3 is an isometric view of an actuating sleeve of FIG. 1.

FIGS. 1 and 2 illustrate that an embodiment of the fluid supply device comprises a container 1, a base member 2, an actuating sleeve 33, an actuating sleeve 31, a cover 4, a pushing member 5, a first elastic member 6, a second elastic member 7, a gasket member 8, and a fixing member 9. In at least one embodiment, the first elastic member 6 and the second elastic member 7 are springs. The fixing member 9 is a pin.

The container 1 comprises an output tube 13 extending perpendicularly from a first end of the container 1, an input tube 14 perpendicularly communicating with the output tube 13, and a cylindrical member 18. A channel 181 is axially defined in the cylindrical member 18 and aligns with the output tube 13. The output tube 13 comprises a valve (not shown) configured to control output of fluid. The input tube 14 comprises a valve (not shown) configured to control input of the fluid. A pair of tabs 16 extends outwards from a second end of the container 1. Each tab 16 centrally defines a through hole 163.

Figure 5:
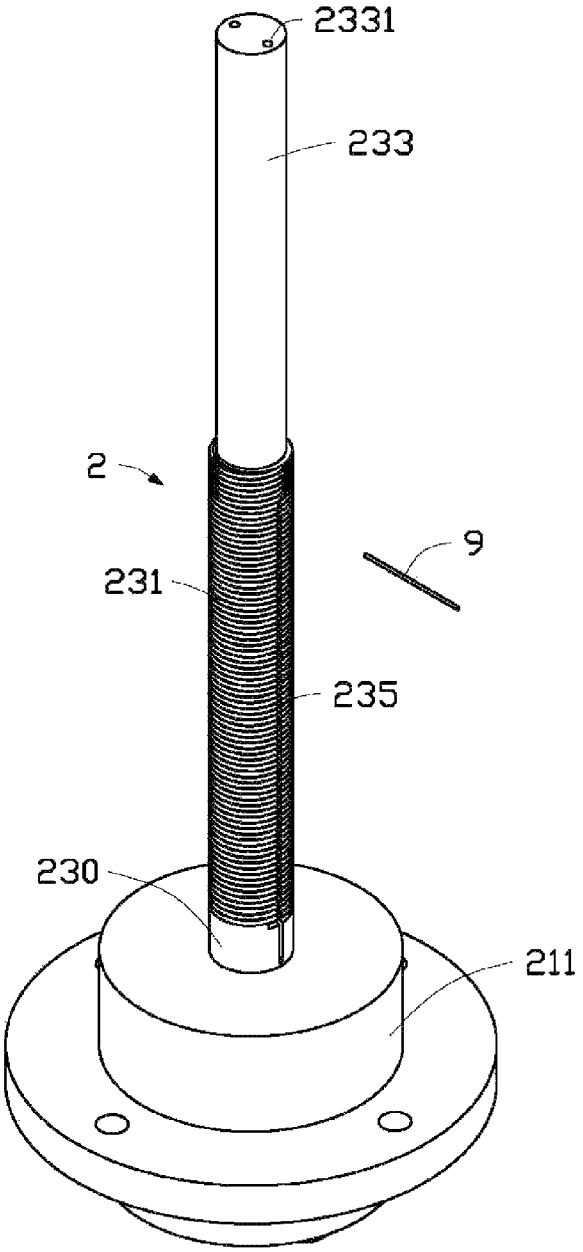
FIG. 5 is an isometric view of a base member of FIG. 1.
Figure 6:
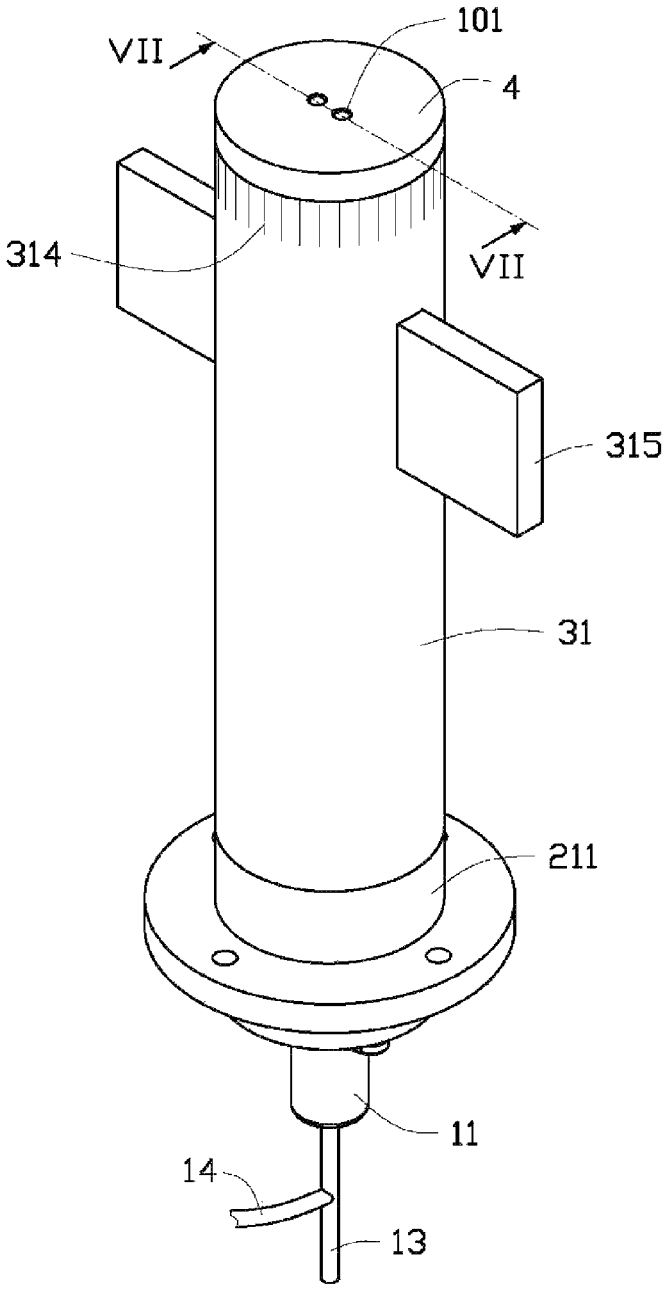
FIG. 6 is an assembled, isometric view of FIG. 1.
Figure 7:
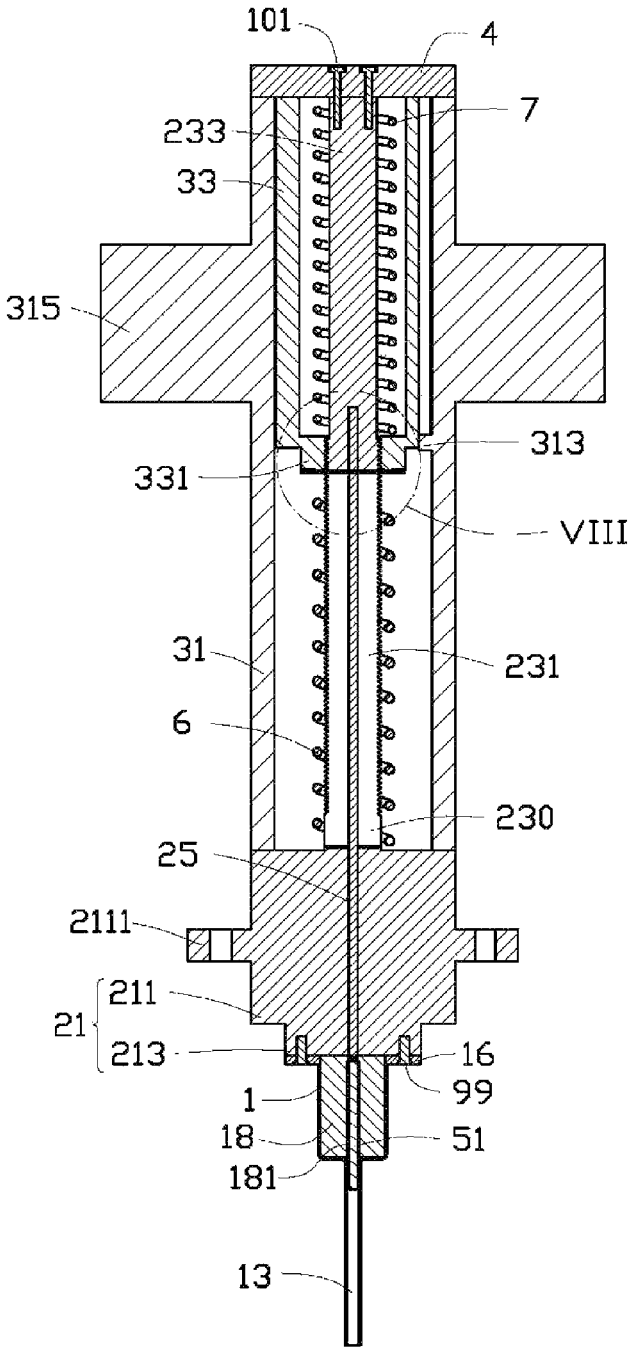
FIG. 7 is a cross sectional view of FIG. 6 taken along line VII-VII.
Figure 8:
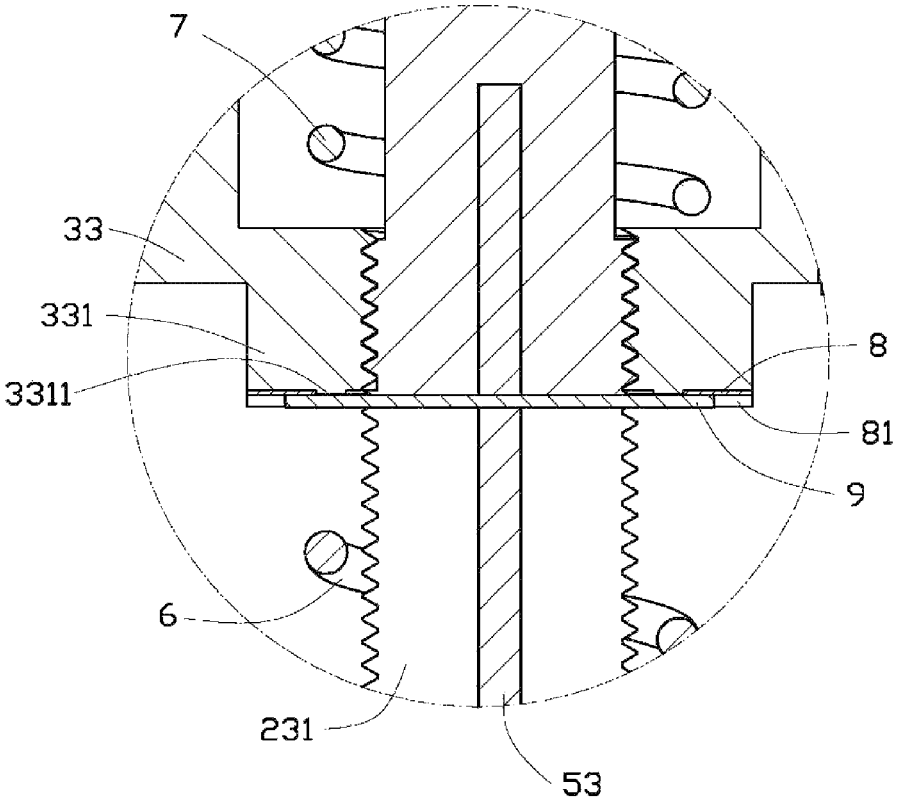
FIG. 8 is an enlarged view of circled portion VIII of FIG. 7.

FIGS. 1-2 and 5 illustrate that the base member 2 comprises an end plate 21 and a rod 23 extending perpendicularly from a middle of a first end of the end plate 21. The end plate 21 comprises a fixing portion 213 formed at a second end of the end plate 21 opposite to the first end, and an annular flange 211 surrounding a middle of the end plate 21. A pair of fixing holes 2131 is defined in the fixing portion 213. The rod 23 comprises a connecting portion 230 coupled with the base plate 211, an external threaded portion 231 extending from the connecting portion 230, and an extending portion 233 extending from the external thread portion 231. A channel 25 (shown in FIG. 7) is axially defined in the rod 23 and extends through the end plate 21. The external thread portion 231 of the rod 23 radially defines a through slot 235. A pair of fixing holes 2331 is defined in the extending portion 233.

FIGS. 1-3 and 7-8 illustrate that the actuating sleeve 31 and the operating sleeve 33. A bar 313 extends axially from an inner side of the actuating sleeve 31. A plurality of evenly distributed scale lines 314 is formed at an outer side of an end of the actuating sleeve 31. A pair of arms 315 extends from the outer side of the actuating sleeve 31 near the scale lines 314. The operating sleeve 33 comprises a connecting portion 331 formed at an end of the operating sleeve 33, and a groove 3331 axially defined in an outer side of the operating sleeve 33. A threaded hole 3310 is axially defined in the connecting portion 331. A ring 3311 extends from an end of the connecting portion 331 away from the operating sleeve 33.

FIG. 1 illustrates the cover 4. A pair of through holes 41 is defined in a middle of the cover 4. An indicator 42 is formed at an outer side of the cover 4.

FIGS. 1 and 2 illustrate that the pushing member 5 comprises a first post 51, a second post 53, and a fixing member 100. A diameter of the first post 51 is smaller than that of the channel 25 and a diameter of the second post 53 is smaller than that of the channel 181. A connecting portion 531 extends from an end of the second post 53 and a through hole 534 is defined in an outside of an end away from the connecting portion of the second post 53. A collar 513 is formed at an end of the first post 51 to receive the connecting portion 531. The fixing member 100 extends through the connecting portion 531 and collar 513 to connect the first post 51 and second post 53 together.

Figure 4:
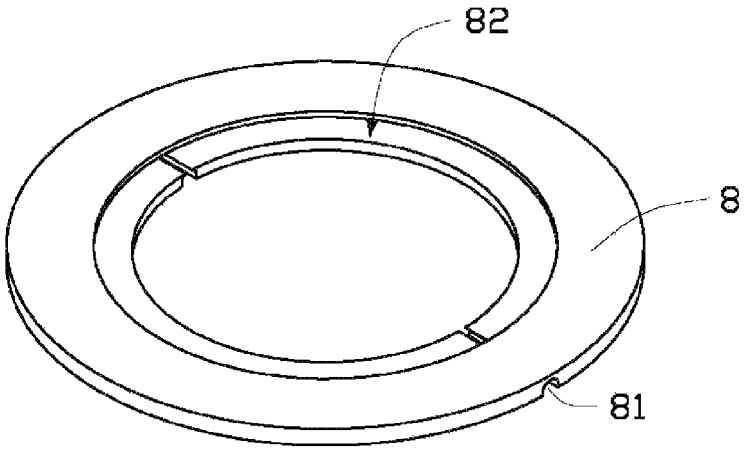
FIG. 4 is an isometric view of a gasket member of FIG. 2.

FIGS. 1-2 and 4 illustrate the gasket member 8. An annular groove 82 is defined in an upper portion of the gasket member 8, and a slit 81 is radically defined in a lower portion of the gasket member 8.

FIGS. 1-2 and 6-8 illustrates the fluid supply device in assembly. The first elastic member 6 and gasket member 8 are sequentially fixed around the rod 23 and the groove 82 is located away from the end plate 21 of the base member 2. The first post 51 is inserted into the channel 181 of the cylindrical member 18. The second post 53 is inserted into the channel 25 of the base member 2, with an end of the second post 53 away from the first post 51 abutting against the rod 23 and the fixing member 9 extending through the through hole 534 of the second post 53, the slit 81 of the gasket member 8, and the through slot 235 of the rod 23.

The container 1 is attached to the fixing portion 213 of the base member 2, with the tabs 16 abutting the fixing portion 213 and a pair of screws 99 extending through the two through holes 163 to engage in the two fixing holes 2131.

The operating sleeve 33 is attached to the base member 2. The ring 3311 is received in the groove 82 of the gasket member 8. An end face of the ring 3311 rotatably abuts against the wall 821 of the groove 82. The gasket member 8 abuts against the connecting portion 331. The external thread portion 231 of the base member 2 threadedly engages in the threaded hole 3310 of the connecting portion 331. Two opposite ends of the first elastic member 6 abut against the gasket member 8 and the end plate 21 of base member 2.

The actuating sleeve 31 is attached to the operating sleeve 33, with the bar 313 of the rotating sleeve 31 slidably engaging in the groove 3331 of the actuating sleeve 31 and an end of the actuating sleeve 31 away from the scale lines 314 abutting against the end plate 21 of the base member 2. The second elastic member 7 is placed around of the rod 23 and received in the operating sleeve 33.

The cover 4 is attached to the rod 23 of the base member 2, with a pair of screws 101 extending through the two through holes 41 to engage in the two fixing holes 2331 respectively. The second elastic member 7 is deformed and two opposite ends of the second elastic member 7 abut against the cover 4 and an inner end of the bar 313.

Figure 9:
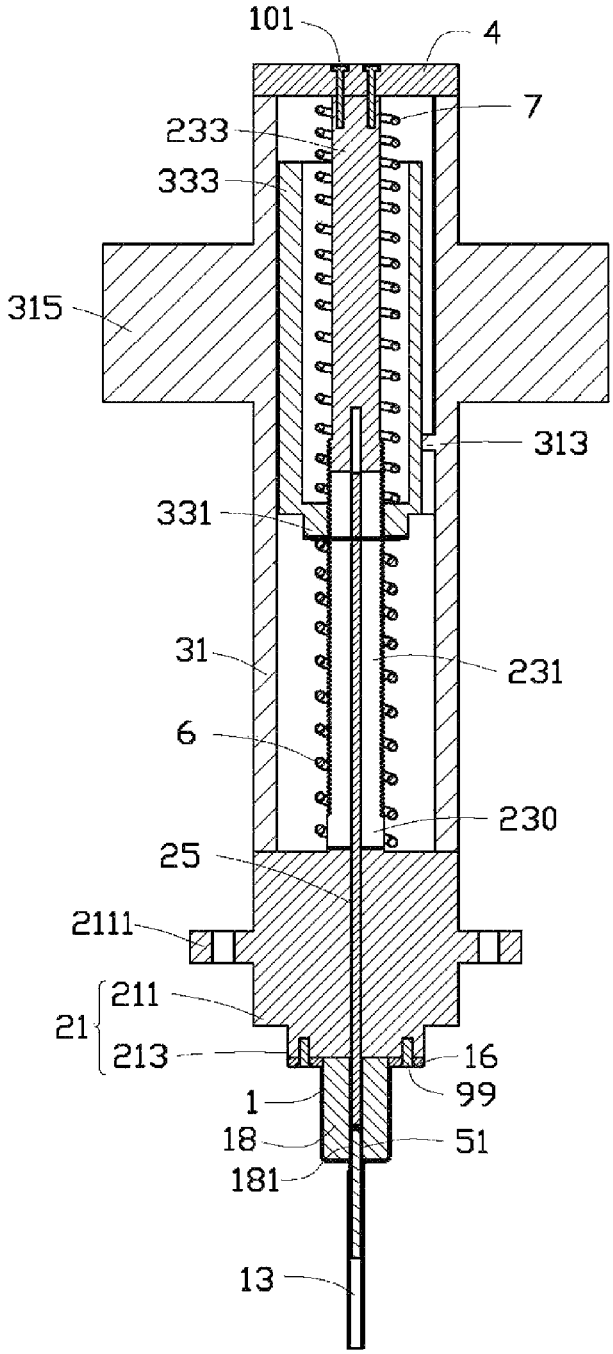
FIG. 9 is similar to FIG. 8, wherein the fluid supply device is in a state of use.

FIG. 9 illustrates the fluid supply device in use. The valves of the output tube 13 and the input tube 14 are adjusted to allow fluid to flow from the input tube 14 to the output tube 13.

The arms 315 are operated to rotate the rotating sleeve 31 to further rotate the operating sleeve 33, until the indicator 42 points to the required scale line 314. The operating sleeve 33 threadedly engages with the external thread portion 231 of the base member 2 to drive the pushing member 5 to slide in the channel 25 and channel 181 to push the fluid in the output tube 13. At the same time, the first elastic member 6 is deformed and the second elastic member 7 rebounds. The ring 3311 of the operating sleeve 33 rotatably abuts against the gasket member 8 to prevent the plate 8 from being rotated by the operating sleeve 33.

In at least one embodiment, the precision of output of the fluid is ensured by controlling thread pitch of the external thread 2311 and the internal thread 3315 and stiffness factor of the first elastic member 6 and the second elastic member 7.

The embodiments shown and described above are only examples. Many details are often found in the art such as the other features of a fluid supply device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A fluid supply device comprising:

a base member comprising an end plate and a rod perpendicularly extending from a first end of the end plate, the rod axially defining a first channel, which extends through the end plate and radially defining a through slot;

a container attached to a second end of the end plate opposite to the first end, in the container defining a second channel to contain fluid therein, wherein the second channel is in alignment with the first channel of the base member;

a pushing member slidably received in the first channel and the second channel;

an actuating sleeve configured to threadedly engage with the rod; and a fixing member attached to the actuating sleeve and extending through the through slot and the pushing member;

wherein the actuating sleeve is rotated to drive the pushing member to slide in the first channel and the second channel to push the fluid.

2. The fluid supply device of claim 1, wherein the pushing member comprises a first post and a second post connected to the first post.

3. The fluid supply device of claim 1, wherein an elastic member is configured to be sandwiched between the fixing member and the end plate.

4. The fluid supply device of claim 3, wherein a gasket member is configured to be attached to the fixing member and be placed around the rod.

5. The fluid supply device of claim 4, wherein a slit is radially defined in the gasket member for the fixing member extending through.

6. The fluid supply device of claim 1, wherein the rod comprises an external threaded portion, the actuating sleeve comprises a connecting sleeve formed at one end thereof, a threaded hole is defined in the connecting sleeve to threadedly engage with the external threaded portion of the rod.

7. The fluid supply device of claim 6, wherein the container comprises an output tube formed at an end thereof away from the base member and a cylindrical member received in the container, the second channel is axially defined in the cylindrical member and in alignment with the output tube.

8. The fluid supply device of claim 7, wherein a pair of tabs extends outward from container to be attached to the end plate.

9. The fluid supply device of claim 8, wherein the end plate comprises a fixing portion to be attached to the pair of tabs.

10. The fluid supply device of claim 6, wherein a rotating sleeve is placed around the actuating sleeve to rotate the actuating sleeve.

11. The fluid supply device of claim 10, wherein a groove is axially defined in an outer side of the actuating sleeve, and a bar axially extends from an inner side of the rotating sleeve to slidably engage in the groove.

12. The fluid supply device of claim 10, further comprising a cover configured to be attached to an end of the rod away from the end plate, wherein the cover abuts against the actuating sleeve and the rotating sleeve.

13. The fluid supply device of claim 12, further comprising an elastic member configured to be sandwiched between the cover and the connecting sleeve of the actuating sleeve.

14. The fluid supply device of claim 12, wherein an outer side of the rotating sleeve near the cover defines a plurality of evenly distributed scale lines, and an indicator is formed at an outer side of the cover.

* * * * *